United States Patent [19]

Kagami et al.

[11] Patent Number: 4,844,638

[45] Date of Patent: Jul. 4, 1989

[54] PAPER FEEDER FOR A PRINTER

[75] Inventors: Isao Kagami, Nagoya; Makoto Hasegawa, Kasugai; Eiji Yokota, Nagoya; Kiyoshi Takahashi, Nagoya; Hiroyuki Funahashi, Nagoya, all of Japan

[73] Assignee: Brother Kogyo Kabushiki Kaisha, Japan

[21] Appl. No.: 153,916

[22] Filed: Feb. 9, 1988

[30] Foreign Application Priority Data

Feb. 17, 1987 [JP] Japan ..... 62-22434[U]
Mar. 26, 1987 [JP] Japan ..... 62-45195[U]

[51] Int. Cl.[4] ..... B41J 13/02
[52] U.S. Cl. ..... 400/636; 271/116
[58] Field of Search ..... 400/636, 636.2, 636.3, 400/637, 637.1, 641, 703, 708, 708.1; 271/109–111, 113, 114, 116

[56] References Cited

U.S. PATENT DOCUMENTS

| | | | |
|---|---|---|---|
| 2,940,754 | 6/1960 | Stoothoff | 271/116 |
| 4,248,415 | 2/1981 | Steinhilber | 271/116 |
| 4,638,987 | 1/1987 | Sakurai | 271/116 |
| 4,709,911 | 12/1987 | Saiki et al. | 271/116 |
| 4,717,139 | 1/1988 | Sootome et al. | 271/116 |

FOREIGN PATENT DOCUMENTS

| | | | |
|---|---|---|---|
| 2843339 | 7/1979 | Fed. Rep. of Germany | 271/109 |
| 3305341 | 9/1983 | Fed. Rep. of Germany | 400/708 |
| 145048 | 11/1981 | Japan | 271/114 |
| 848023 | 9/1960 | United Kingdom | 271/109 |
| 2131351 | 6/1984 | United Kingdom | 400/636.2 |

OTHER PUBLICATIONS

"Selectively Controllable Document Feed Device", IBM Tech Discl. Bulletin, vol. No. 11, Apr. 1966, 1636–1638.

"Document Picker and Separator", IBM Tech. Discl. Bulletin, vol. 14, No. 8 (Jan. 1972), pp. 2265–2266.

"Document Feeder Mechanism for a Printer", IBM Tech. Discl. Bulletin, vol. 29, No. 5, Oct. 1986, pp. 2190–2192.

*Primary Examiner*—Eugene H. Eickholt
*Attorney, Agent, or Firm*—Oliff & Berridge

[57] ABSTRACT

A paper feeder for a printer in which a paper separator roller 15 is rotatably provided in the end portion of a paper holder 12 so that when a paper feed roller 14 is rotated in the paper feed direction, the paper separator roller 15 is arranged to stop at a predetermined position and act similarly to a conventional friction pad, while when the paper feed roller 14 is rotated in the paper return direction, the paper separator roller 15 also rotates in synchronization with the above rotation. By way of vibrating the paper separator roller 15 in the rotational direction or another direction, paper sheets P stacked on the paper holder 12 are vibrated for the purpose of being successively moved in the portion at which the two rollers 14 and 15 are positioned in contact with each other. As a result of this structure, the paper feeder of the printer according to the present invention can be prevented from local abrasion of the paper separator roller 15 causing papers to be fed in an overlap manner, and stop of paper feed can be prevented, and papers can be assuredly fed one at a time to the printing mechanism portion 1.

8 Claims, 4 Drawing Sheets

PAPER FEEDER FOR A PRINTER

BACKGROUND OF THE INVENTION

This invention relates to a paper feeder for a printer for feeding to a printing mechanism portion one at a time paper sheets which are stacked on a paper holder.

A known device of the type described above is disclosed in Japanese Patent Laid-Open No. 60-61436.

In this conventional device, a paper feed roller is provided in such a manner that it is arranged to be positioned in contact with the front end of paper sheets stacked on a paper holder. Furthermore a friction pad for separating paper sheets from each other is forcedly positioned in contact with the paper feed roller so that when a first paper sheet is fed in association with the rotation of the paper feed roller, simultaneous feeding of a second sheet is prevented by means of the friction pad.

In such a conventional device of the type described above, the upper surface of a first paper sheet which has been inserted is held by a paper feed roller by means of its frictional force in the place where the paper feed roller and the friction pad are positioned in contact with each other. Furthermore, the lower surface of the inserted second paper sheet is held by the friction pad by means of its frictional force so as to overcome the frictional force between the two sheets, thereby allowing only the first paper sheet to be fed in association with the rotation of the paper feed roller.

However, in such a conventional device, since the friction pad is always positioned in forced contact with the paper feed roller at a same position of the friction pad, the friction pad becomes worn and paper dust accumulates on the friction pad. As a result of this, the frictional force becomes gradually poorer, causing the paper separation performance to deteriorate and eventually two or more paper sheets are inevitably fed together.

Furthermore, when only a first paper sheet, rather than the first and the second paper sheets together, of a multiplicity of paper sheets stacked on a paper holder is inserted into the portion at which the paper feed roller and the friction pad are positioned in contact with each other, both the frictional force of the paper feed roller and the frictional force of the friction pad are simultaneously applied to the first paper sheet. As a result of this, the first paper sheet is captured by the friction pad and this prevents the paper feed from occurring properly.

SUMMARY OF THE INVENTION

An object of the present invention is therefore to realize an assured feeding of paper sheets one at a time to a print mechanism portion without any local wear of the friction pad or accumulation of paper dust which would cause double sheet feeding.

Another object of the present invention is to insert assuredly a first paper sheet together with a second paper sheet into a portion at which a paper feed roller and a friction pad are positioned in contact with each other, whereby paper supply stoppage is prevented, and paper sheets can be assuredly fed one at a time to a printing mechanism portion.

In order to achieve the above described objects, the end portion of the paper holder is provided with a paper separator roller as an alternative to the friction pad, the paper separator roller being limited in its rotation in the paper feeding direction to a predetermined angular extent. As a result of this, when the paper feed roller rotates in the paper feeding direction, the paper separator roller stops at a predetermined position, whereby, as playing a similar role to that performed by the friction pad, the lower surface of the second paper sheet is held by the paper separator roller with the frictional force of the same, and only the first paper sheet is fed to the printing mechanism. On the other hand, when the paper feed roller rotates in the paper returning direction, the paper separator roller freely rotates in the paper returning direction in synchronization with the rotation of the paper feed roller. As a result of this, the limitation of the force contact portion is prevented, and local abrasion of the paper separator roller can be prevented.

Furthermore, since the paper separator roller rotates together with the paper feed roller in the paper returning direction, paper dust falls off so that there is no reduction in the frictional force of the paper separator roller which acts to hold the paper sheets.

Furthermore, the paper separator roller is repeatedly rotated with quickly alternate directions either the paper returning direction or the paper feeding direction, in order to vibrate the paper sheets which are stacked on the paper holder. As a result of this, the first paper sheet can be assuredly introduced with the second paper sheet into the portion at which the paper feed roller and the paper separator roller are positioned in contact with each other. Also in order to apply vibration to the paper sheets, the extent of rotation of the paper separator roller in the paper returning direction may be limited. Furthermore, the vibration may be applied, for example, in the vertical direction in addition to application in the rotational direction.

As described above, the paper separator roller which is provided as an alternative to the friction pad may be protected against local wear or accumulation of paper dust, whereby feeding of overlapping paper sheets can be prevented.

Furthermore, by vibrating the paper separator roller in the rotational direction or another direction, the paper sheets stacked on the paper holder can be introduced into the portion at which the paper feed roller and the paper separator roller are positioned in contact with each other along the surface of the paper separator roller, whereby the second paper sheet can be assuredly inserted with the first paper sheet into the above contact-portion. As a result of this, paper supply stoppage can be prevented.

As described above, according to the present invention, paper sheets can be assuredly fed once at a time to the printing mechanism portion.

DETAILED DESCRIPTION OF PREFERRED EMBODIMENTS

Referring to the accompanying drawings, some embodiments of the present invention will now be described in detail.

A paper feeder according to a first embodiment of the present invention in which an object of the present invention is realized, that is, overlapping paper feed can be prevented will now be described.

Figure 1:
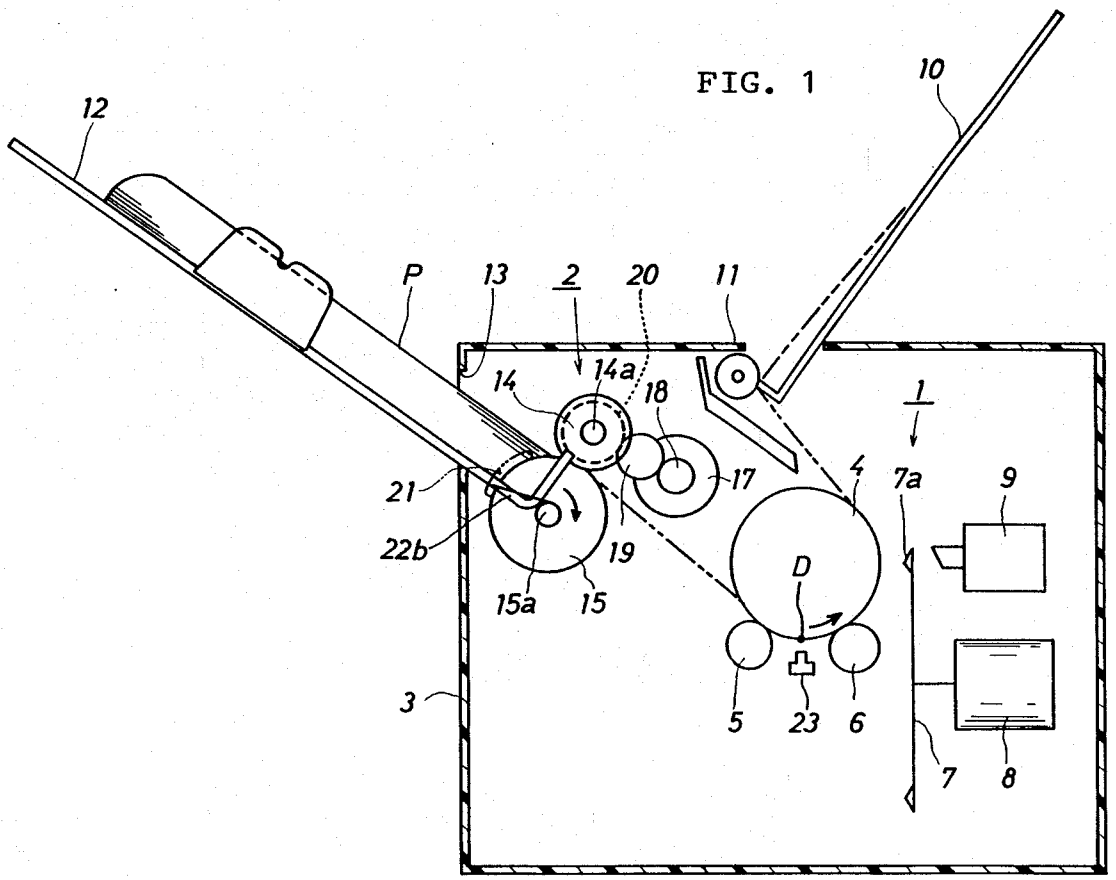
FIG. 1 is a cross-sectional view of a printer according to an embodiment of the present invention.

As shown in FIG. 1, a printing mechanism portion 1 and a paper feeder 2 are provided in a frame 3 of a printer. Paper sheets P are supplied one at a time from the paper feeder 2 to the printing mechanism portion 1. The printing mechanism portion 1 is provided with a platen 4 for supporting a paper sheet on its cylindrical surface, a pair of guide rollers 5 and 6 each of which is positioned in contact with the platen 4, a daisy wheel 7, a character-selection motor 8 which rotates the daisy wheel 7 for the purpose of selecting and positioning a predetermined character *7a* at a position opposing a typing surface of the platen 4, and a hammer 9 for impacting the selected character *7a* to the paper sheet on the platen 4 for conducting printing.

Above the printing mechanism portion 1 described above, a stacker 10 for stacking printed paper sheets and a roller 11 for feeding the paper sheets on the platen 4 to the stacker 10 are provided.

Then, a paper feeder will now be described. In the frame 3, the lower end of a paper holder 12 is provided with a paper separator roller 15. In the diagonally upper portion of the paper separator roller 15 is provided with a paper feed roller 14 in such a manner that it is positioned in contact with the surface of the paper separator roller 15. The paper feed roller 14, paper separator roller 15, and platen 4 are each rotatably supported by the corresponding parallel shafts.

The paper feed roller 14 is arranged to rotate in the paper feed direction or paper return direction relative to a rotational shaft 14*a* by a pulse motor 17 which is provided in the frame 3 through gears 18, 19 and 20.

The paper holder 12 is detachably mounted in a mounting opening 13 in the frame 3 in a slanted manner, and on the upper surface thereof is stacked a multiplicity of paper sheets P.

In the central portion of the front end of the paper holder 12 is provided with a recess 16 in which the paper separator roller 15 is positioned when the paper holder 12 is mounted, and the front end of the paper sheet P is brought into contact with the outer periphery of the paper separator roller 15. The paper feed roller 14 is made of a rigid material such as hard rubber or the like, while the paper separator roller 15 is made of a soft elastic material such as soft rubber or the like which is prevented from permanent deformation.

On one side of the paper separator roller 15, a side wall of the frame 3 is provided with a circular-arc shaped guide groove 21 which is disposed relative to a rotational shaft 15*a*.

The rotational shaft 15*a* is provided with a spring clutch 22 for limiting the rotation of the paper separator roller 15 in the paper feeding direction and allowing it to rotate freely in the paper return direction.

The spring clutch 22 comprises a coil portion 22*a* and a fastening hook 22*b*.

The coil portion 22*a* is wound starting from the end portion of the rotational shaft 15*a* toward the paper separator roller 15 in the paper feeding direction (the direction designated by an arrow in FIG. 1).

The fastening hook 22*b* is continuously formed at the end portion of the side wall side of the coil portion 22*a*, and is slidably inserted into the guide groove 21.

In association with the rotation of the paper feed roller 14 in the paper feeding direction, the paper separator roller 15 and the spring clutch 22 are rotated in the paper feeding direction. In this state, the fastening hook 22*b* upwardly moves along the guide groove 21 until it is fastened at the top end of the guide groove 21. As a result of this, the fastening hook 22*b* acts to stop the rotation of the coil portion 22*b* in the paper feeding direction, as a result of which the coil portion 22*a* is wound onto the rotational shaft 15*a*. Consequently the paper separator roller 15 is locked up by the spring clutch 22, and its rotation in the paper feeding direction is prevented. The following operation of the paper separator roller 15 is the same as that done by the conventional friction pad.

On the other hand, when the paper feed roller 14 is rotated in the paper return direction, the paper separator roller 15 and the spring clutch 22 are rotated in the paper return direction and the fastening hook 22*b* is fastened at the lower end of the guide groove 21.

Then the aforementioned winding state is not realized because the coil portion 22*a* is pushed back by the fastening hook 22*b*.

Therefore, the paper separator roller 15 can be freely rotated in the paper return direction.

Thanks to the above described structure, in association with the rotation of the paper feed roller 14 by means of the pulse motor 17 in the paper feeding direction, the paper separator roller 15 rotates in the paper feeding direction, and the fastening hook 22*b* of the spring clutch 22 is moved along the guide groove 21. When the fastening hook 22*b* comes into engagement with the top end of the guide groove 21, the winding of the coil portion 22*a* onto the rotational shaft 15*a* starts. When the winding is completed, the rotation of the paper separator roller 15 is stopped. In association with this rotation of the paper separator roller 15, a first paper sheet, which is the top sheet of the stacked paper sheets P, is introduced into the portion at which the two rollers 14 and 15 are positioned in contact with each other, and a second paper sheet and the followers are waited on the paper holder 12 in such a manner that the second sheets and the followers are positioned in contact with the paper separator roller 15.

When the front end of the first paper sheet is introduced into the portion between the platen 4 and the first lead roller 5 by successive rotation of the paper feed roller 14, this paper sheet is fed to a predetermined paper detecting position D in association with the rotation of the platen 4 in the paper feeding direction (direction designated by the arrow). When the front end of the paper sheet is detected by a paper detecting sensor 23, the platen 4 and the paper feed roller 14 are rotated in the paper return direction in order to assuredly align the front end of the residual paper sheets P stacked on the paper holder 12 to the axial line of the platen 4.

In this state, the rotational movement of the paper feed roller 14 is conducted to the paper separator roller 15 through the first paper sheet, whereby the rotational force in the paper return direction is applied to the paper separator roller 15. Since this rotational force is applied in the direction opposite to the winding direction of the coil portion 22*a*, the rotation of the paper separator roller 15 is free from restriction by the spring clutch 22, it is thus freely rotated. Therefore, the position at which the paper separator roller 15 is brought into contact with the paper feed roller 14 always moves when the paper feeder 2 is operated. As a result of the movement, the local abrasion of the paper separator roller 15 which would cause the frictional force between the two rollers 14 and 15, and between the paper separator roller 15 and a paper sheet to deteriorate can be previously prevented. Furthermore, since paper dust caused by interference between the paper sheet and the two roller 14 and 15 falls off in association with the rotation of the paper separator roller 15, it does not accumulate on the paper separator roller 15. As a result of this, the decrease in the frictional force due to the paper dust can be prevented. Consequently, overlapping feed of paper sheets can be prevented, and the paper sheets can be assuredly one at a time fed to the printing mechanism portion 1.

Figure 3:
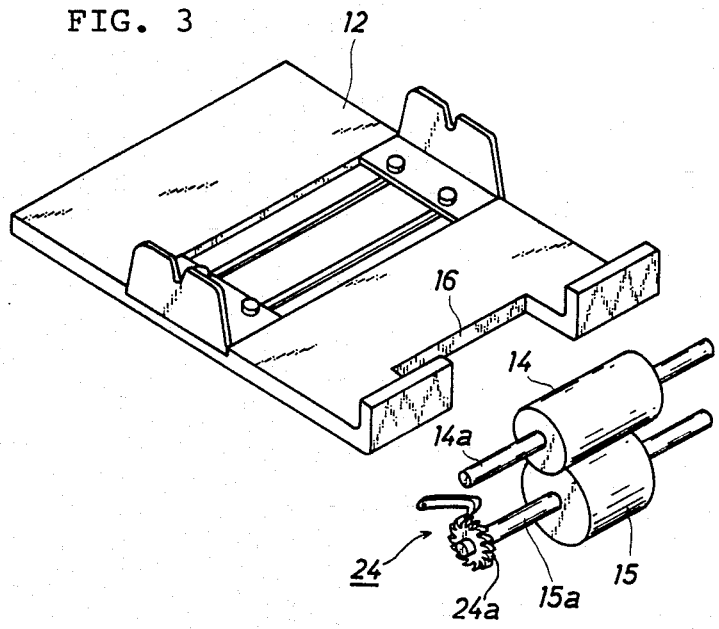
FIG. 3 is an exploded perspective view of an essential portion of the paper feeder according to another embodiment in which a ratchet mechanism is employed.

As an alternative to the spring clutch 22, a ratchet mechanism 24 as shown in FIG. 3 may be provided on the rotational shaft 15*a* of the paper separator roller 15. The paper separator roller 15 is rotatable in both the paper feeding and the paper returning directions. The paper separator roller 15 limits the rotation in the paper feeding direction to a predetermined rotational angular extent. The predetermined rotational angular extent is decided by the intervals of cogs 24*a* of the rachet mechanism 24.

Another object of the present invention, that is, a second embodiment of a paper feeder of a printer in which paper supply stop is prevented will now be described.

Figure 2:
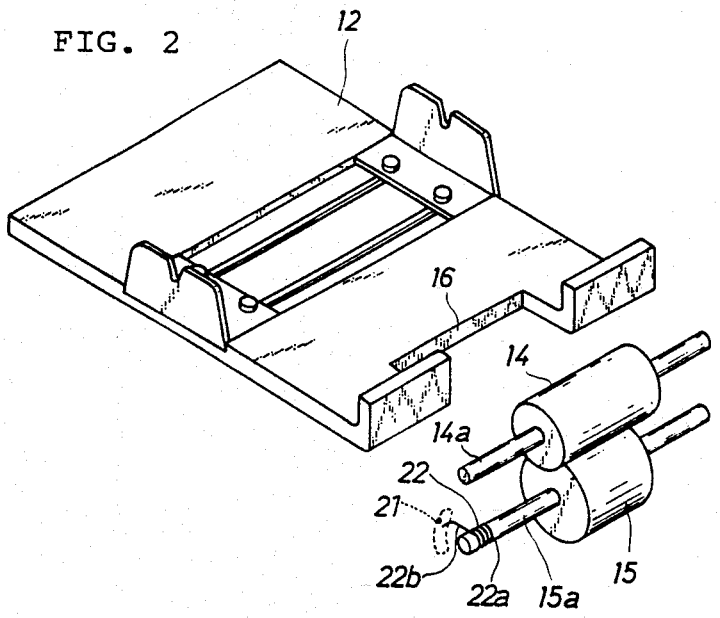
FIG. 2 is an exploded perspective view of an essential portion of a paper feeder for the printer shown in FIG. 1.

The paper feeder of a printer according to this embodiment is constituted in the similar manner to that of the first embodiment (see FIGS. 1 and 2). The paper sheets P stacked on the paper holder 12 are controlled to be vibrated for the purpose of assuredly feeding the second paper sheet together with the first paper sheet to a portion at which the paper feed roller 14 and the paper separator roller 15 are positioned in contact with each other. The procedure of the control will now be described with reference to the accompanying drawings.

Figure 4:
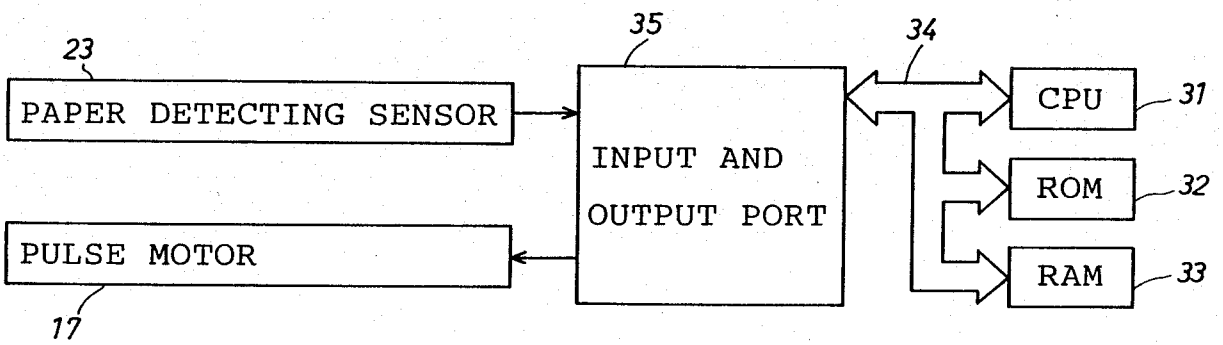
FIG. 4 is a block diagram of a control device for a printer according to a second embodiment.

As shown in FIG. 4, a control device according to this embodiment comprises a CPU 31, a ROM 32, and a RAM 33. A paper detection signal from a paper detection sensor 23 is input through a common bus 34 and an input and output port 35. On the other hand, a driving signal is supplied to the pulse motor 17.

Figure 5:
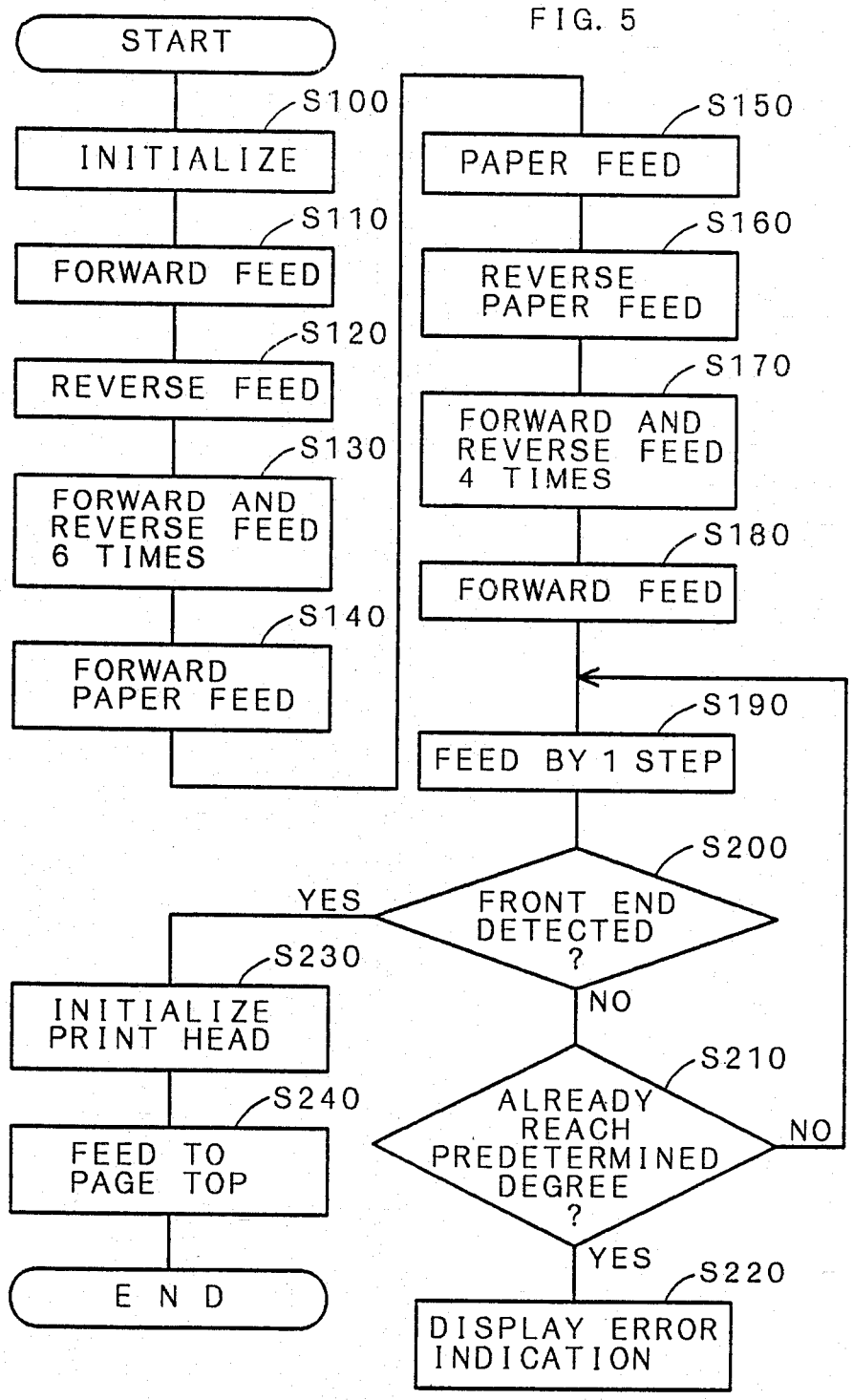
FIG. 5 is a flow chart illustrating a procedure of the control of the printer.

Referring to a flow chart shown in FIG. 5, the processing procedure which is conducted by the above described control device will now be described.

When the control by means of the CPU 31 begins, various memories and flags or the like are initialized in step S100. Then, the pulse motor 17 is, in step S110, driven to rotate through a predetermined angular extent in the paper feeding direction, whereby the paper feed roller 14 is rotated in the paper feeding direction. Then, the pulse motor 17 is, in step S120, driven to rotate through a predetermined angular extent in the paper return direction, whereby the paper feed roller 14 is rotated in the paper return direction. As a result of this, the paper separator roller 15 is rotated in synchronization with the paper feed roller 14 by way of the processes of steps S110 and S120 until it is positioned at the initial position, that is, the position at which the fastening hook 22*b* is positioned at the lower end of the guide groove 21. Then, the pulse motor 17 is, in step S130, driven six times by a slight step in both forward and reverse directions, and the paper feed roller 14 and the paper separator roller 15 are vibrated in both forward and reverse directions in accordance with the above drive of the pulse motor 17.

As a result of the vibration, the paper sheets P which are stacked on the paper holder 12 are vibrated, and the paper sheets P are moved along the surface of the paper separator roller 15, and the second paper sheet together with the first paper sheet is assuredly introduced into the portion at which the two roller 14 and 15 are positioned in contact with each other.

Then, in step S140, in order to assuredly hold the front end of the thus introduced two sheets between the two rollers 14 and 15, the pulse motor 17 is forwardly rotated by a slight step, whereby the paper feed roller 14 is rotated in the forward direction. As a result of this, the two sheets are assuredly held by means of the two rollers 14 and 15.

In the next step S150, in order to feed a paper sheet to the printing mechanism portion 1, the pulse motor 17 is rotated in the forward direction by a predetermined step, whereby the paper feed roller 14 is driven to rotate. As a result of this, the front end of the first paper sheet on the paper holder 12 is moved by a predetermined distance toward the platen 4 and thereby held between the first lead roller 5 and the platen 4, and stops there. The platen 4 is driven to rotate in synchronization with the pulse motor 17, and it stops after it holds the first paper sheet in cooperation with the first lead roller 5.

Then, a process of aligning the front end of the residual paper sheets P stacked on the paper holder 12 to the axial line of the platen 4 is executed.

The pulse motor 17 is first, in step S160, rotated in the reverse direction by a predetermined step, and the above described second sheet is returned to the paper holder 12. Then, in step S170, the forward and reverse feeding operation is carried out four times respectively in the similar manner to that in step S130.

As a result of this, the second sheet and the followers which are stacked on the paper holder 12 are vibrated, as a result of which, they are successively moved to and aligned in the portion at which the two rollers 14 and 15 are positioned in contact with each other.

Then, in step S180, the pulse motor 17 is rotated in the forward direction by a predetermined step, and the second sheet is again inserted into the portion at which the two rollers 14 and 15 are positioned in contact with each other.

Then, in step S190, the pulse motor 17 is rotated forwardly by one step, and in step S200, it is determined by a paper detecting sensor 23 whether the front end of the first paper sheet reaches a predetermined position (point D in the FIG. 1).

If any detection signal is not detected by the paper detecting sensor 23, the flow advances to step S210 in which it is determined whether the cumulative rotation of the pulse motor 17 in the paper feed direction has become a predetermined extent. If it is determined in step S210 that it has become the extent, that is, if the paper is not fed normally although a predetermined paper feed action is carried out, the flow advances to step S220. In this step S220, an error indication is displayed by a display device (not shown).

On the other hand, if it is determined in step S210 that it has not become the extent, that is, when a predetermined paper feed action has not been completed, the flow returns to step S190 in which the aforesaid process is repeated.

Then, the processes of steps S190 to S210 are repeated, and if it is determined to be YES in step S200, the flow advances to step S230 in which the printing mechanism portion 1 is initialized. As a result of this, a print head comprising the daisy wheel 7, the character-selection motor 8 and the hammer 9 is moved to a position at which printing starts, and in step S240, the first paper sheet is fed to the print start line on the platen 4 in the forward direction, whereby feed of the first paper sheet to the printing mechanism portion 1 is completed.

As described above, in this embodiment, the paper separator roller 15 is vibrated by means of the paper feed roller 14 which is rotated by the pulse motor 17, whereby the second sheet below the top sheet on the paper holder 12 is assuredly inserted into the portion at which the paper feed roller 14 and the paper separator roller 15 are positioned in contact with each other. As a result of this, the first paper sheet is assuredly fed to the printing mechanism portion 1 without any occurrence of feed stop.

Furthermore, in this embodiment, since the pulse motor 17 which drives the paper feed roller 14 is also serves as vibrating means for the paper separator roller 15, the number of parts can be decreased causing manufacturing cost to be kept low.

Obviously, many modifications and variations of the present invention are possible in the light of above teachings. It is therefore to be understood that within the scope of the appended claims, the invention may be practiced otherwise than as specifically described.

For example, exclusive driving means for vibrating the paper separator roller 15 may be provided.

Furthermore, the paper separator roller 15 may be vibrated in the direction, for example, in the vertical direction with play provided for the rotational shaft 15*a*.

What is claimed is:

1. A paper feeder for a printer which is constituted in such a manner that paper sheets stacked on a paper holder are fed one at a time to a printing mechanism portion in a printer comprising:

a paper separator roller which is provided to rotate in both a paper feeding and a paper returning direction at an end portion of said paper holder;

a paper feed roller which is provided in contact with said paper roller, and which is rotatable in both the paper feeding and paper returning directions around a shaft which is parallel to a shaft of said paper separator roller;

a rotational angular extent limiting means for limiting a rotation of said paper separator roller in the paper feeding direction to a predetermined rotational angular extent; and a drive means that drives said paper feed roller in said rotational directions.

2. A paper feeder for a printer according to claim 1, wherein said paper separator is driven to rotate in association with the rotation of said paper feed roller.

3. A paper feeder for a printer according to claim 1, wherein said rotational angular extent limiting means comprises a spring and a guide groove, the spring having a coil portion wound onto said shaft of said paper separator roller and a fastening hook disposed at an end of said coil portion for engaging with the guide groove.

4. A paper feeder for a printer according to claim 1, wherein said rotational angular extent limiting means is a ratchet mechanism which is provided on said shaft of said paper separator roller.

5. A paper feeder for a printer according to claim 1, wherein vibrating means for vibrating said paper separator roller is provided.

6. A paper feeder for a printer according to claim 5, wherein said vibrating means vibrates said paper separator roller in said rotational directions.

7. A paper feeder for a printer according to claim 6, wherein said paper feed roller also serves as said vibrating means and is controlled by a control means to apply vibration by way of repetition of its rotation in the forward and reverse directions.

8. A paper feeder for a printer according to claim 1, wherein said paper feed roller is made of a rigid material, while said paper separator roller is made of a soft elastic material.

* * * * *